United States Patent [19]

Bemm et al.

[11] 4,289,342

[45] Sep. 15, 1981

[54] MOTOR VEHICLE DOOR LOCK

[75] Inventors: Wulf W. Bemm, Cologne; Günter Weber, Wuppertal, both of Fed. Rep. of Germany

[73] Assignee: Neiman S.A., Courbevoie, France

[21] Appl. No.: 85,360

[22] Filed: Oct. 16, 1979

[30] Foreign Application Priority Data

Oct. 26, 1978 [DE] Fed. Rep. of Germany ..... 2846550

[51] Int. Cl.[3] ..... E05C 3/12

[52] U.S. Cl. ..... 292/49; 292/201

[58] Field of Search ..... 292/45, 52, 49, 201, 292/213, 214, 217

[56] References Cited

U.S. PATENT DOCUMENTS

| | | | |
|---|---|---|---|
| 1,512,141 | 10/1924 | Segal | 292/49 |
| 1,535,625 | 4/1925 | O'Bannon | 292/52 |
| 2,832,620 | 4/1958 | De Orlow | 292/52 |
| 4,093,289 | 6/1978 | Inabayashi et al. | 292/201 X |

FOREIGN PATENT DOCUMENTS

| | | | |
|---|---|---|---|
| 1149140 | 7/1957 | France | 292/217 |

*Primary Examiner*—Richard E. Moore
*Attorney, Agent, or Firm*—James C. Wray

[57] ABSTRACT

A motor vehicle door lock comprises a ratchet locking mechanism, behind the preferably bolt-shaped catch of which there can engage the flanks of two locking teeth which are arranged one behind the other and which are arranged on a pivotable locking lever which is pressed into the locking position by spring pressure and which, upon a movement of the catch relative to the lever during the locking of the door, can be pivoted by the catch against the spring pressure. For the opening of the lock there engages in the locking lever (9) or is secured thereto, a driving member (28), by means of which the locking lever can be removed from the catch (2) to such an extent that the respective abutting tooth edge becomes disengaged.

36 Claims, 7 Drawing Figures

MOTOR VEHICLE DOOR LOCK

BACKGROUND TO THE INVENTION

The invention relates to a motor vehicle door lock comprising a ratchet locking mechanism, behind whose preferably bolt-shaped catch there can engage the flanks of two locking teeth which are arranged one behind the other and which are arranged on a pivotable locking lever which is pressed into the locking position by spring pressure and which, upon a movement of the catch relative to the lever during the locking of the door, can be pivoted against the spring pressure.

STATEMENT OF PRIOR ART

Such a lock is known from German Auslegeschrift No. 15 53 375. In this known lock, the locking lever is hinged to the door post and is movable by the pin-shaped catch against the pressure exerted by a spring, so that the locking pin secured in the door can engage behind the teeth of the lever. For releasing the lock, the locking pin is rotated about its longitudinal axis so as to be removed from the area of the locking teeth of the lever. Such a construction is expensive and susceptible to trouble since the operation of this lock necessitates a movement of both the locking lever and the locking pin.

OBJECT OF THE INVENTION

It is the object of the invention to improve a lock of the kind mentioned at the beginning in such a way that, while being of simple construction and having few movable parts and small dimensions, it has a high degree of reliability.

SUMMARY OF THE INVENTION

According to the invention, this problem is solved in that for opening the lock there engages in the locking lever or is secured thereto a driving member, by means of which the locking lever can be removed from the catch to such an extent that the respective abutting tooth edge becomes disengaged.

Irrespective of whether, in this construction, the lever is secured to the door and the catch is secured to the door post or whether this arrangement is vice versa, it is always only the lever which is moved for locking and unlocking so that a simple construction is provided and only few sources of faults can arise. Both during locking and unlocking, the lever is moved through the same small angle of rotation into the same direction of rotation. The catch and the lever are directly interlocked with no other locking part having to engage in the lever. A small angle of rotation of the lever is also of special advantage if the lock is driven electromagnetically, more especially electromotively, pneumatically or hydraulically.

A preferred proposal is to the effect that there should bear against the catch, on the side that is opposite to the locking lever, a second lever which is of similar construction and which can be pivoted, against the spring pressure, in the position opposite to that of the first lever. By this means, there is provided a particularly reliable support of the catch and the levers respectively, since the engagement of one single tooth in one of the levers is already sufficient for locking. It is true that delaying forces caused by an accident can, in the most unfavourable case, move one of the levers into an opening position, but the other lever is then loaded all the more in the locking direction by the same forces so that the locking effect is maintained at least by one lever. A particularly simple and reliable construction is provided if both levers are arranged and designed so as to be pivotally symmetrical about an axis which coincides with the movement path (axis of rotation) of the catch.

A particularly simple construction as well as a reliable co-operation of the lever or levers with the catch is ensured in that the pivot(s) of the lever or levers are directed towards the catch when the catch is not introduced, so that the catch first touches a lever area that is close to the pivots. In the locking position, the levers may converge from the pivots towards their free ends so that they form an entry gap. However, it is also possible for the design of the levers to be such that they have a V-shaped entry gap between the pivots. The levers can then be parallel to each other in the unlocked position.

The driving part for the lever or levers does not have to be fixedly connected to these but may only bear against the lever or levers, this being the case on the side of the lever or levers against which the catch bears. By this means, it is also possible to provide a clearance between the driving member and the lever (s) in the position of rest of the driving member so that, upon a movement of the driving member, this member first has to pass over this clearance before it engages in the respective lever. This is of particular advantage if the driving member is driven by motor, since the motor can reach a sufficient rotational speed during the play before it has to do work.

In a two-lever arrangement, the driving member is thus arranged between the levers so that both levers are movable by one single driving member. A particularly simple and small-sized constructional form is provided in that the driving member lies between the free ends of the levers. By this means, it is possible to make optimum use of each section of the lever or levers. An entry area of the lever, which also receives the pivot, is followed by the area of the locking teeth and directly thereafter by the area in which the driving member engages.

The driving member may be a cam shaft or a cam disc which may be more especially of pivotally symmetrical design so as to move both levers simultaneously through the same angle of rotation. In the position of rest, the axis of symmetry of a driving member constructed in such a way is aligned with the axis of symmetry of the levers and the movement path of the catch. Expediently, the axis of rotation of the cam shaft or cam disc is parallel to the axes of rotation of the locking levers. Furthermore, the axis of rotation of the driving member should intersect the movement path (axis of rotation) of the catch.

The driving member may have an oval cross section and will consequently produce a very even transformation of a rotary movement into a transverse movement of the levers. A very small construction is brought about if the driving member is plate-shaped and if, in the position of rest in which the lever or levers are not actuated, the central plane of the plate passes through the lengthened relative movement path (axis of rotation) of the catch. The driving member is rotatable through a maximum angle of rotation of 90°. Depending on the construction of the driving member and the catch, substantially smaller angles of rotation may be sufficient.

A preferred proposal is to the effect that the driving member should be secured on a shaft which passes through the front wall of the door and carries in the door interior a transmission lever which is movable by transmission parts by means of the door handles or buttons to be operated by hand. By this means, essential parts are arranged in the interior of the door and only a small number of parts is housed in the lock housing provided on the front wall of the door.

To bring about a high simplicity of construction, the driving member is to be actuatable by hand or by a drive only into the position causing unlocking and is to reach the position of rest automatically. This measure, which increases safety, is brought about in that the driving member or the transmission lever is acted on by a spring which presses this member or lever into a position in which the driving member is in the position of rest in which the lever or levers are not operated.

A preferred proposal is to the effect that the bolt-shaped catch should have a wedge-shaped cross section, whose point points in the direction of the relative movement of the catch during the locking of the door. The wedge-shaped configuration of the catch ensures a particularly easy introduction thereof between the locking levers.

The locking levers are housed so that they are protected and require little maintenance if the catch is introduceable into a slotted plate of the lock housing, into whose slot the teeth of the lever or levers extend laterally. By this means, the locking levers are also given an optimum lateral guidance for the absorption of lateral bending forces. These forces arise particularly if the catch has a head which engages behind the lever or levers at the flat sides thereof, so as to ensure that this head bears against the lever side faces which are opposite to the slotted plate so that forces pulling away from one another can be absorbed by the door and the door post. A constructionally simple and protected design is provided in that the lever (s) and the driving member are arranged in a housing which is secured to the front face of the door and whose wall that is parallel to the door front face forms the slotted plate.

A great number of advantages is provided if the lever or levers is (are) movable to the unlocked position by an electromagnetic, electromotive, pneumatic or hydraulic drive, particularly against spring pressure. Such a lock does not necessitate, at least for the external operation of the door, any mechanical connection or transmission parts. By this means, the external operation of the door, the cylinder lock and the door lock become spatially independent of one another. The lock may be remotely controlled and is particularly suitable for central locking mechanisms. While conventional locks to which an electric, hydraulic or pneumatic drive was additionally attached have hitherto been used for central locking mechanisms, such a drive is provided on this lock from the outset so that there is no need for a plurality of parts. This also allows a simple control to be constructed which applies to the entire motor vehicle. A preferred proposal is to the effect that the drive should be an electric motor. By this means, it is possible for the rotatable levers to be driven directly from the electric motor through a gearing so that a driving member arranged between the lever ends is not absolutely necessary or is only provided for manual operation.

It is particularly advantageous if the drive actuates the driving member since further fastening means on the locking levers are then not required. In the event of the drive being an electric motor, a gearing between the electric motor and the driving member may be of very simple construction since the driving member only has to carry out a rotary movement.

A constructionally particularly simple embodiment and a reliable mode of operation are provided if, when the energizing of the drive has ended, the lever or levers is (are) movable into the locking position by spring pressure. By this means, the return of the locking levers to the locking position becomes independent of the drive. A gearing of particularly simple construction is provided in that there is arranged on the shaft a gear which is driven directly from the pinion of the drive or through an intermediate gear. The gear can run freely with respect to the shaft to a limited extent, so as to ensure an actuation of the drive by the motor independently of a mechanical actuation by the inside door handle. With simple means, it is made possible to actuate the driving member for the rotatable levers both by the motor and by hand. By this means, the safety regulations are also complied with within a very confined space. In this regard, it is furthermore proposed that the free running should correspond to the angle of rotation which the driving member requires for the actuation of the lever or levers. A simple constructional form is brought about in that the rotational movability of the gear with respect to the shaft is limited by a pin which is secured to the transmission lever and which extends into a circular-segment-shaped slot in the gear.

The drive may be constructed in such a way that after having finished its action, it automatically returns to the starting position. However, this can be further simplified in that for finishing the action of the drive, this latter, including the driving member, is returned to the starting position by spring force.

In order to facilitate the starting of the drive of an electric motor, it is proposed that there should be provided between the transmission lever and the transmission parts a play which allows a rotational movability of the transmission lever with respect to the transmission part adjoining it. The size of the aperture in the transmission part for manual operation, through which the link pin of the transmission lever passes, is such that the transmission lever can be freely moved in accordance with the actuation path. Furthermore, the play between the transmission parts which is required for the compensation of tolerances can be designed in an advantageous manner for the rotational movability of the drive.

The locks according to the invention can be used in a particularly advantageous manner if at least two thereof are arranged in a central locking system of a motor vehicle. A particularly simple control is provided if the electromagnetic or electromotive drive of each lock is connected in series with a switch which is actuated at least by the external door handle or the external door button and in that the electric supply to each of these electric circuits is controlled by a relay whose two positions are separated by electric circuits in which switches of the door locking cylinders, which are operated by keys, are inserted.

The relay may have a bistable trigger which is alternately brought into one of the two positions by a current impulse generated through at least one of the door locking cylinders. By this means, the switches actuated by the door locking cylinders have to actuate only one single electric circuit. However, alternatively, there may be controllable by at least one of the door locking cylinders two electric circuits, of which the first causes the relay to be closed and the second causes it to be opened. By this means, there is provided the conventional operation of a lock by a key.

In order to allow the motor vehicle to be locked from the interior, it is proposed that there should be arranged inside the motor vehicle, preferably on the instrument panel, a switch which through an electric circuit causes the relay to open. In order to allow the locks also to be actuated in the event of the battery of the motor vehicle failing, it is proposed that there should be provided, in addition to the electric circuit provided for the actuation of the relay, another electric circuit which actuates the relay and is fed by an emergency supply battery and is controllable at least by the lock of the driver's door.

BRIEF DESCRIPTION OF DRAWINGS

An exemplified embodiment of the invention is shown in the drawings and will be described in more detail hereinafter. In the drawings

DESCRIPTION OF PREFERRED EMBODIMENT

Figure 1:
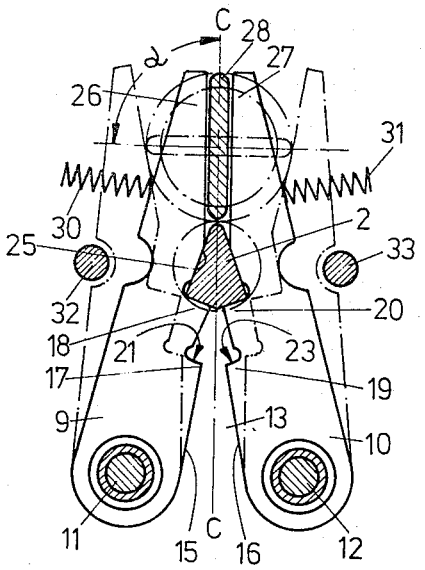
FIG. 1 shows a side view of the locking levers along B—B in FIG. 1.
Figure 6:
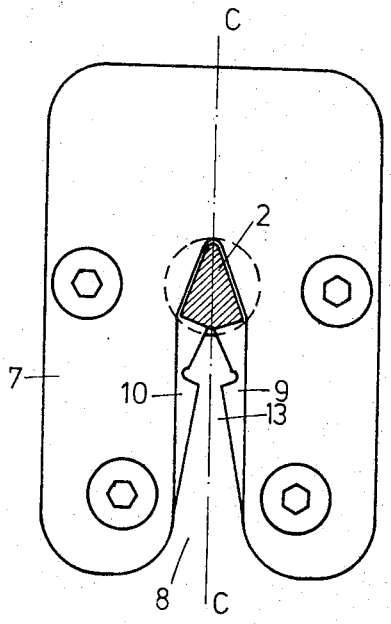
FIG. 6 shows a top view of the slotted plate according to the arrow Y in FIG. 2.
Figure 2:
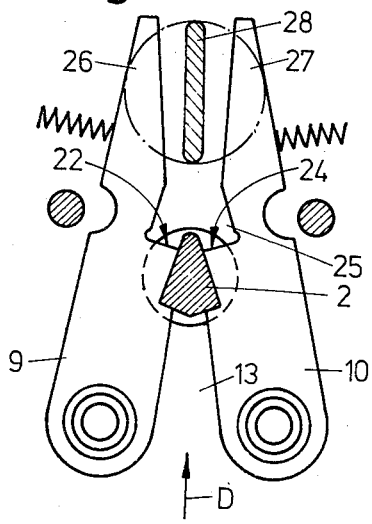
FIG. 2 shows a view like FIG. 1, but instead of showing the fully locked position it shows the safety position.

To the door post 1 of a motor vehicle there is secured a bolt-shaped catch (block) 2, whose longitudinal axis is parallel to the motor vehicle longitudinal axis. The locking bolt 2 has a V- or arrow-shaped cross section, the axis of symmetry C—C of the cross section being horizontal and the acute angle of the cross section pointing away from the motor vehicle to the exterior. At the level of the locking bolt, there is screwed to the front wall 4 of the motor vehicle door a lock housing 3, the screws 5 provided for this purpose being held in a reinforcing plate 6, which is secured to the inside of the front wall 4. The housing 3 forms, with its wall that is parallel to the front wall 4, a slotted plate 7 (FIG. 6) whose slot 8 is horizontal and is provided at the level of the locking bolt 2 so that the locking bolt 3 can be received. At its end, the slot 8 is of V-shaped design in accordance with the locking bolt 2. Against the inside of the slotted plate 7 there rest two locking levers 9 and 10 which are hinged, at their ends which are directed towards the motor vehicle interior, by means of pivots 11 and 12 which are vertically arranged one above the other, these pivots being so spaced that there exists between the lever ends a distance which is at least as large as the maximum height of the locking bolt 2. The levers 9 and 10 converge towards their outwardly pointing free ends, so that there exists between them an acute-angled entry gap 13 for the locking bolt. The locking bolts 11 and 12 are arranged and designed so as to be pivotally symmetrical about the horizontal axis of symmetry, the relative movement path of the locking bolt 2 also extending in this axis of symmetry. The locking bolt 2 has at its end a circular-disc-shaped head 14 which, when the door is closed, engages behind the vertical locking lever side faces and comes into contact with these when the post and the door are forcibly pulled apart parallel to the direction of travel.

The internal front faces 15, 16 of the locking levers 9 and 10 form respectively two locking teeth 17 to 20 in the area of the entry gap 13, the outwardly directed front faces 21 to 24 of these locking teeth being tangentially arranged so as to form circles around the associated pivots 11 and 12. The teeth and the locking bolt form a ratchet locking mechanism wherein the locking levers 9 and 10 can assume 2 positions with respect to the locking bolt 2 (the safety position and the fully locked position). The front faces 21 and 23 and 22 and 24 respectively bear against the rear of the locking bolt, which rear is divided into two surfaces which are at acute angles to each other and which are parallel to the front faces.

In the safety position and in the fully locked position, it is not only the front faces 15, 16 of the locking levers which bear against the locking bolt side faces in the area of the locking tooth flanks 21 to 24, but the other front face areas also bear against the locking bolt or extend very closely parallel thereto so that, in the locking condition, the locking levers form two recesses which correspond approximately to the cross section of the locking bolt. The recess 25 intended for the fully locked position adjoins in the outward direction an area in which the free locking lever ends 26, 27 form, with their front faces, a parallel spacing, in which a disc-shaped driving member 28 lies. With the locking levers in the locking position, the central plane of the driving member disc is horizontal and in the axis of symmetry C—C. The driving member 28, which is rectangular in the top view, is arranged in a rotation-proof manner on the front face of a shaft 29 which is horizontal and parallel to the pivots 11, 12. During a rotation of the shaft 29 about the longitudinal axis, the plate-shaped driving member 28 is swung from the horizontal, during which process a side edge of the driving member moves a locking lever and the opposite side edge moves the second locking lever outwards against the pressure exerted by the compression springs 30 and 31. The locking levers are prevented from being swung too far outwardly by stops 32 and 33 (32 and 33=fastening screws). The shaft 29 is mounted in a bush 34 which is secured in the front wall 4 and the plate 6. The bush 34 is surrounded by a ring 35 which consists of an elastomer and serves as a cushioning stop for the head 14 of the locking bolt 2.

At the end of the shaft 29 that extends into the interior of the door, a two-arm angle lever (transmission lever 36) is arranged in such a rotation-proof manner that the shaft 29 is in the centre of the lever. A pin 37, which runs in a long hole 38 in a draw rod 39, is fastened to a first free end of the lever 36 so as to be axially parallel to the shaft 29. At the end that is opposite to the lever 36, the draw rod 39 is hinged to a toggle lever 40 which is hinged, in the knee, to a support 41 and whose shorter free lever end is connected to the inside door actuating device. When the inside door actuating device is operated, the transmission lever 36 is swivelled, taking along the shaft 29 and the driving member 28 and thus pressing apart the locking levers 9 and 10 into the unlocked position. Following the operation of the inside door actuating device, the lever 36 is moved back in the opposite direction of rotation by the spring 42 so that the driving member 28 is again horizontal and the locking levers can be pressed again into the locking position by the springs 30 and 31.

Figure 5:
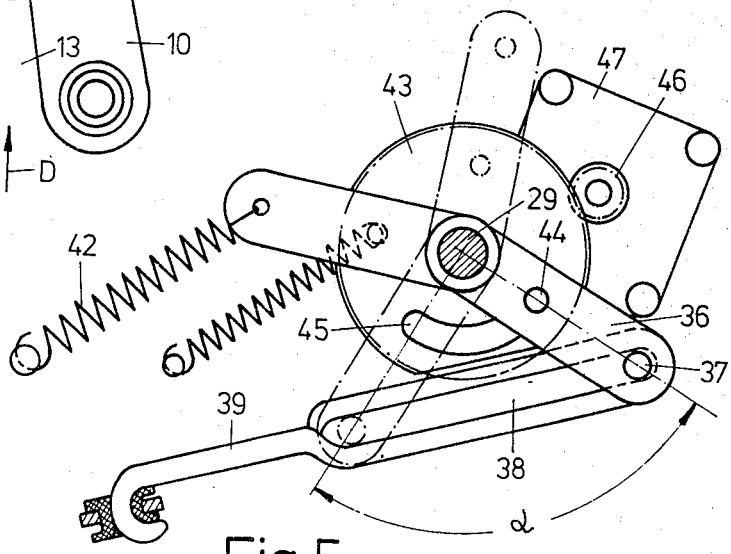
FIG. 5 shows a section through FIG. 2 along the line A—A in FIG. 2.
Figure 3:
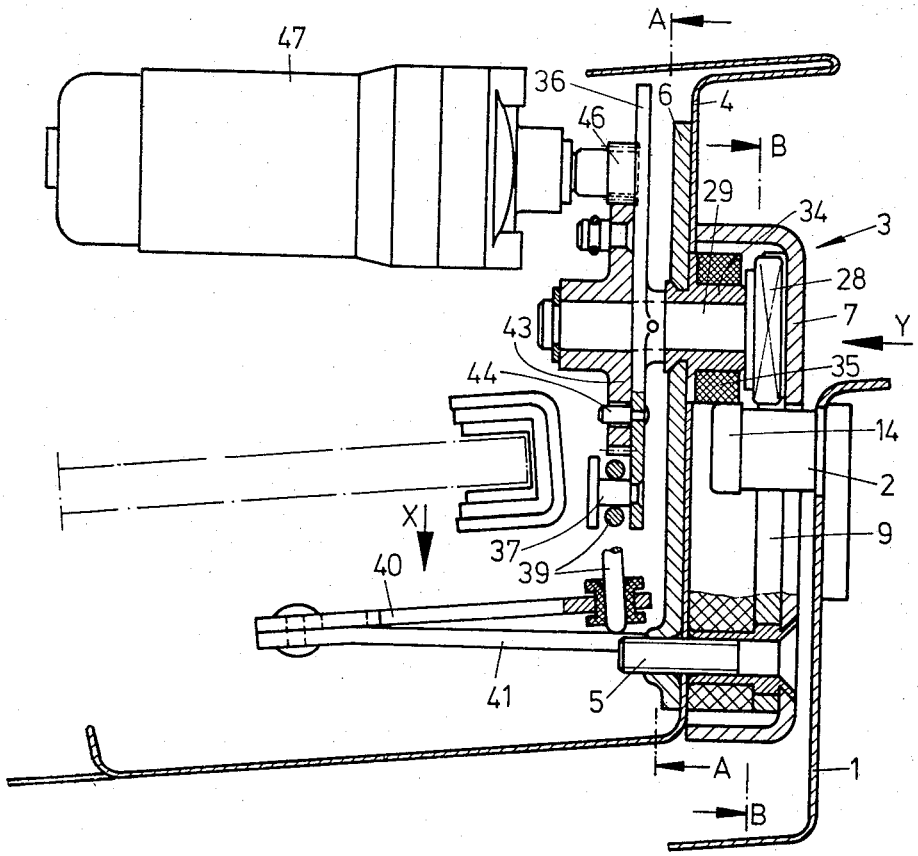
FIG. 3 shows a horizontal section through a lock and through parts of the door and the door post.
Figure 4:
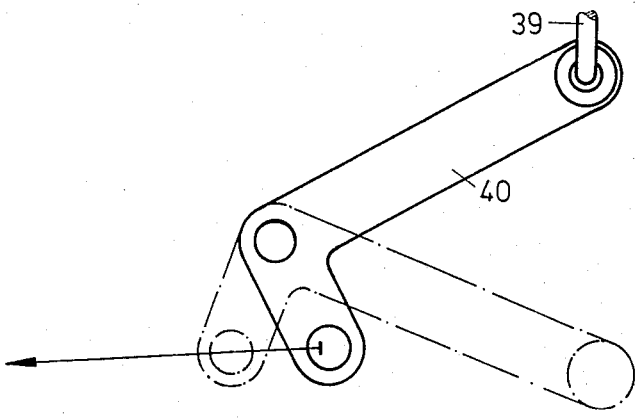
FIG. 4 shows a view of a toggle lever viewed from the arrow X in FIG. 2.

At the inside end of the shaft 29, a gear 43 is mounted so as to be rotatable within limits, the limitation being effected by a pin 44 which is secured to the lever 36 and extends into a part-circle-shaped free-run slot 45 in the gear. The spur gear 43 meshes with a pinion 46 which is secured on the shaft of an electric motor 47. Upon the actuation of the electric motor, the spur gear 43 rotates through an angle of rotation of 90° (in the clockwise sense in FIG. 5) taking along the lever 36 through the pin 44 so that the shaft 29 and the driving member 28 are actuated. By this means, due to the electric motor 47 being energized, the locking levers 9 and 10 can be pressed away from each other so as to release the locking bolt 2 and to allow an outward movement of the locking levers 9 and 10 and thus of the door. When the lever 36 is actuated by the electric motor, the rod 39 is not moved since the pin 37 is moved in the oblong hole 38. Once the energizing of the electric motor is completed, the lever 36 is turned back into the starting position by the spring 42, the gear 43 being taken along and the motor being rotated in the opposite direction. In order to prevent the rotation work of the motor rotor, the pinion 46 may be arranged in such a way that the pinion 46 is disengaged from the gear during the return movement of the lever 36. This alternative, which is not shown, works similarly to the pinion of a motor vehicle starter motor since the pinion only meshes with the teeth of the gear 43 when the electric motor is energized. Instead of being driven by an electric motor, the shaft 29 may be driven by a solenoid or by a hydraulic or pneumatic cylinder-piston unit.

Figure 7:
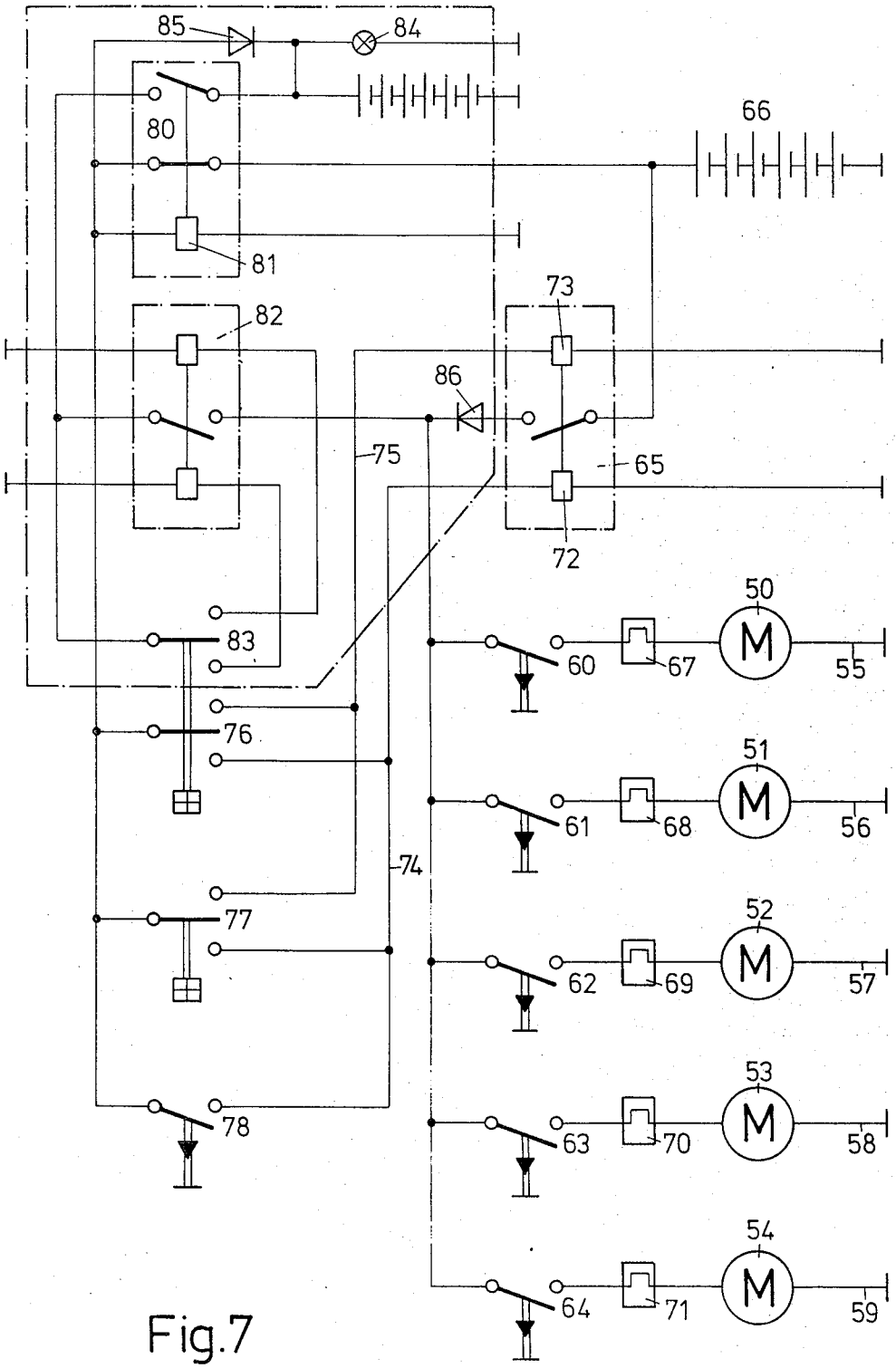
FIG. 7 shows an electric circuit diagram of a motor vehicle locking system having five locks according to the invention.

The electric motor 47 is actuated by a monostable switch which is connected to the respective external door button. In FIG. 7, there are shown several electrically actuatable locks in a switching circuit of a motor vehicle. In each of the four motor vehicle doors there is arranged a lock, each having a motor 50 to 53, and the rear door or the luggage compartment lock has another motor 54. The motors 50 to 54 are arranged in separate circuits 55 to 59, in which there are connected in series monostable switches 60 to 64, each of which is actuated by the outside door button of each door and by the luggage compartment lock button respectively. Between the electric circuits 55 to 59 there is connected a relay 65 which, acting as a bistable switch, in the opened position interrupts the current passing from the vehicle battery 66 to the circuits 55 to 59. In these circuits, there are furthermore arranged time limiters 67 to 71 which ensure that even if the switches 60 to 64 are switched on for a prolonged time, the motors 50 to 54 will only be energized for a limited time.

The switching element of the relay 65 is moved into the two positions by solenoids 72, 73, the solenoid 72, which causes the relay to open, being connected in an electric circuit 74 and the solenoid 73, which causes it to close, being connected in an electric circuit 75. The electric circuits 74, 75 are closed by monostable switches 76, 77, the final control elements of these switches being movable from the stable zero position into two opposed positions, one of the two electric circuits 74 and 75 being closed in each of these positions. The switch 76 is actuated by the locking cylinder core of the driver's door and the switch 77 is actuated by the locking cylinder core of the front seat passenger's door. This allows the relay to be switched on and off by the actuation of the key in one of the two locking cylinders of the front doors, so that the five locks 60 to 64 are actuatable or are disconnected from the motor vehicle battery. Parallel to the switches 76 and 77 there is arranged in the electric circuit 74 a monostable switch 78 which by button pressure can be brought from the stable zero position into the closed position and which can by this means open the relay 65. The switch 78 is fitted to the instrument panel in the interior of the vehicle and produces a central locking of the vehicle that is actuatable from inside.

In the event of the vehicle battery failing, there is provided a second chargeable battery 79 which is switched on through a relay 80, whose solenoid 81, if the vehicle battery fails, interrupts the current connection thereto and switches on the emergency supply battery 79. The work of the relay 65 is then assumed by a relay 82 which is controlled through a monostable switch 83 which in its construction equals the switches 76 and 77 and is connected, in addition to the switch 76, to the locking cylinder core of the driver's door. The constant operational readiness of the emergency supply battery 79 can be monitored by a charging control lamp 84. In the emergency supply circuit and in the connection of the vehicle battery to the electric circuits 60 to 64, there are inserted diodes 85, 86 which ensure an independent function of the emergency current supply even if a short circuit arises in the main electric circuit.

We claim:

1. A motor vehicle door lock comprising:

(a) a catch for attachment to the vehicle door frame, (b) a pivoted locking lever for mounting on the door of said vehicle, said locking lever being movable between an engagement position and a disengaged position, (c) two teeth on said locking lever provided one behind the other in the direction of relative movement between said catch and locking lever, said teeth being shaped to cooperate with said catch, (d) a spring urging said locking lever into a locking position, (e) a shaft which when the lock is mounted on the vehicle passes through the vehicle door wall, (f) door lock operating means, (g) transmission levers between said door lock operating means and said shaft, (h) a driving member secured to said shaft, which upon actuation effects a pivotal movement of said locking lever into an unlocked position against the action of the spring, whereby relative movement between the catch and the locking lever to the disengaged position can take place, and (i) a spring which urges the driving member into a position in which the driving member is in a rest position in which the locking lever is not operated.

2. A lock according to claim 1, wherein a second lever, which is of similar design to said first lever and is pivotable in the direction opposite to that of the first lever against spring pressure, bears against the catch on the side that is opposite to the first locking lever.

3. A lock according to claim 2, wherein both levers are arranged and designed so as to be pivotally symmetrical about an axis which coincides with the relative movement path of the catch.

4. A lock according to claim 2, wherein the pivoted ends of the levers are directed towards the catch with the latter in the disengaged position, the catch first touching regions of the levers which are close to the pivots during the relative movement to effect engagement of the catch and lever.

5. A lock according to claim 2, wherein in the locking position, the levers converge from the pivoted ends towards their free ends.

6. A lock according to claim 2, wherein in the locking position, the levers form a converging entry gap for the catch between the pivots.

7. A lock according to claim 2, wherein in the unlocked position, the levers are parallel to each other.

8. A lock according to claim 1, wherein the driving member bears against the lever on that side against which the catch also bears.

9. A lock according to claim 2, wherein the driving member is arranged between the levers.

10. A lock according to claim 9, wherein the driving member lies between the free ends of the levers.

11. A lock according to claim 2, wherein the driving member is a cam.

12. A device according to claim 11, wherein the axis of rotation of the cam is parallel to the axis of rotation of the locking levers.

13. A lock according to claim 1, wherein the axis of rotation of the driving member intersects the relative movement path of the catch.

14. A lock according to claim 1, wherein the driving member has an oval cross section.

15. A lock according to claim 1, wherein the driving member is plate-shaped and, in the locking position of the lever, the central plane of the plate passes through an extension of the relative movement path of the catch.

16. A lock according to claim 1, wherein the driving member is rotatable through a maximum angle of rotation of 90°.

17. A lock according to claim 1, wherein the bolt-shaped catch has a wedge-shaped cross section, the narrow end of which points in the direction of the relative movement of the catch during the locking of the door.

18. A lock according to claim 2, wherein the catch is introducable into a slotted plate, the teeth of said levers extending laterally into a region defined by planes containing the edges of the plate slot.

19. A lock according to claim 2, wherein the catch comprises a head which engages behind the levers on the flat sides thereof.

20. A lock according to claim 18, wherein the levers and the driving member are arranged in a housing which is secured to the front face of the door and whose wall that is parallel to the door front face forms the slotted plate.

21. A lock according to claim 2, wherein the levers are movable into the unlocked position by one of an electromagnetic, electromotive, pneumatic and hydraulic drive against the spring pressure.

22. A lock according to claim 21, wherein the electromagnetic drive is an electric motor.

23. A lock according to claim 21, wherein when the energizing of the drive has been completed, the levers are movable into the locking position by the spring pressure.

24. A lock according to claim 21, wherein the drive actuates the driving member.

25. A lock according to claim 24, having a shaft, on which the driving member is secured, actuated from the drive through a gearing.

26. A lock according to claim 25, wherein on the shaft there is arranged a gear which is driven directly from a pinion of the drive.

27. A lock according to claim 26, wherein the gear has a limited free run with respect to the shaft.

28. A lock according to claim 27, wherein the free run corresponds to the angle of rotation which the driving member requires for the actuation of the levers.

29. A lock according to claim 26, wherein the rotational movability of the gear with respect to the shaft is limited by a pin which is secured to the transmission lever and which extends into a circular-segment-shaped slot in the gear.

30. A lock according to claim 21, wherein for ending the action of the drive this latter, including the driving member, is returned to the starting position by a spring.

31. A lock according to claim 29, wherein between the transmission lever and the transmission parts there exists a play which allows a rotational movability of the transmission lever with respect to the transmission part adjoining it.

32. A lock according to claim 21, wherein the electromotive drive of the lock is connected in series with a switch which is actuated by one of the external door handle and the external door button, the current supply to said drive being controlled by a relay, the two positions of which being controlled by electric circuits including key operable switches.

33. A lock according to claim 33, wherein the relay comprises a bi-stable trigger which is alternately moved into one of the two positions by a current impulse generated by at least one of the switches.

34. A lock according to claim 33, wherein there are energizable two electric circuits, of which the first causes the relay to be closed and the second causes it to be opened.

35. A lock according to claim 33, wherein inside the motor vehicle, there is provided a switch which causes the relay to be opened via an electric circuit.

36. A lock according to claim 33, wherein in addition to the electric circuit provided for the actuation of the relay, there is provided at least one further electric circuit which actuates the relay and which is fed by an emergency supply battery.

* * * * *